United States Patent [19]

Kelly

[11] 4,387,507

[45] Jun. 14, 1983

[54] METHOD AND APPARATUS FOR RADIALLY EXPANDING TUBES

[75] Inventor: John W. Kelly, Burbank, Calif.

[73] Assignee: Haskel Engineering & Supply Co., Burbank, Calif.

[21] Appl. No.: 255,789

[22] Filed: Apr. 20, 1981

[51] Int. Cl.[3] ..... B23P 15/26; B23P 17/00; B23P 11/02; B21D 39/20

[52] U.S. Cl. ..... 29/727; 29/421 R; 29/523; 29/157.4; 72/58

[58] Field of Search ..... 72/58, 60, 61; 29/157.4, 421 R, 523, 283.5

[56] References Cited

U.S. PATENT DOCUMENTS

| | | | |
|---|---|---|---|
| 2,458,854 | 1/1949 | Hull et al. | 72/58 |
| 2,704,104 | 3/1955 | Mueller | 72/58 |
| 2,748,463 | 6/1956 | Mueller | 29/523 |
| 3,200,027 | 3/1969 | Hoffman | 72/61 |
| 3,432,916 | 3/1969 | Fisher | 29/516 |
| 3,583,187 | 6/1971 | Kontranowski | 72/58 |
| 3,595,047 | 7/1971 | Fanning et al. | 72/58 |
| 4,068,372 | 1/1978 | Kamohara et al. | 72/58 |
| 4,152,821 | 5/1979 | Scott | 29/237 |
| 4,343,170 | 8/1982 | Hufton | 29/421 R |

*Primary Examiner*—Ervin M. Combs
*Assistant Examiner*—Steven E. Nichols
*Attorney, Agent, or Firm*—Fulwider, Patton, Rieber, Lee & Utecht

[57] ABSTRACT

A method and apparatus for expanding tubes radially, particularly useful for anchoring tubes within a tube sheet in preparation for a subsequent hydraulic swaging operation. The apparatus includes at least one primary expander and at least one seondary expander. The secondary expander is axially positioned within the tube and has a larger cross-sectional area than the primary expander when considered with reference to a plane passing transversely through the tube. The expanders are compressed axially, thereby producing outwardly directed pressure against the interior surface of the tube. The primary expander produces the greatest pressure against the tube due to its smaller cross-sectional area. Axial compressive forces can be applied to the expanders by a draw bar that passes through them.

14 Claims, 5 Drawing Figures

METHOD AND APPARATUS FOR RADIALLY EXPANDING TUBES

FIELD OF THE INVENTION

The present invention relates to a method and apparatus for expanding tubes, and is particularly suitable for anchoring tubes within a tube sheet in preparation for a subsequent swaging operation.

BACKGROUND OF THE INVENTION

It is frequently desired to expand a tube radially to form a leak-proof joint between the exterior of the tube and a surrounding member. Tube expansion is conventionally produced by either roller swaging or hydraulic swaging. Roller swaging employs a mechanical implement which is inserted in the tube and pressed against the tube surface, forcing the tube wall outwardly. The implement or roller is repeatedly passed over the interior tube surface until the desired expansion has been produced.

Hydraulic swaging, which is generally superior, particularly for high pressure applications in small diameter tubes, employs a mandrel which is inserted in the tube and employed to seal two ends of an elongated annular volume between the outside of the mandrel and the inside of the tube. Hydraulic fluid under pressure, which may be as high as 30,000 psi or more, is then introduced to the annular volume, forcing the tube to expand.

One environment in which the use of swaging to expand tubes radially plays a roll of great importance is in the construction of heat exchangers, particularly those heat exchangers intended for use in nuclear power plants. Hydraulic swaging, using pressures among the highest attainable, is found to be the most effective for this demanding application. A problem that arises, however, is that of anchoring the tube within the tube sheet in preparation for the high pressure swaging operation.

An objective of the present invention is to provide a new and improved method and apparatus for expanding a tube radially. A further objective is to provide such a method and apparatus that are particularly suitable for use in connection with the anchoring of tubes in a tube sheet in preparation for a subsequent swaging operation.

SUMMARY OF THE INVENTION

An apparatus constructed in accordance with the present invention is capable of accomplishing the above objectives and of generating selective radially expansive pressures within axially separate regions of the tube. The apparatus comprises a primary expander and a secondary expander, adapted to be axially alligned within the tube. The secondary expander has a larger cross-sectional area than the primary expander when considered with reference to a plane passing transversely through the tube. Means are provided for compressing the expanders axially with respect to the tube and thereby producing outwardly directed radial pressure against the interior of the tube wall. In addition to anchoring the tube within the tube sheet, the secondary expander performs the functions of positioning the tube within the tube sheet and holding the tube against the apparatus. The primary expander, because of its smaller cross-sectional area, produces a commensurately greater radial pressure and can be used to flare the end of the tube.

Axial compression of the expanders can be caused by a draw bar. Preferably, the expanders are ring-shaped and the draw bar is slidable within them. A sleeve can be used to fill the gap between the draw bar and the primary expander. Preferably, the expanders are made of polyurethane which is a solid, but under high pressure haves like a liquid.

The apparatus can include an anvil that serves as an abutment to position the apparatus relative to the tube. A hydraulic cylinder, which may be connected to the anvil, can be used in combination with a piston to actuate the draw bar.

When the apparatus is used to anchor a tube within a tube sheet in preparation for a subsequent swaging operation, the draw bar and expanders are inserted in the tube so that the primary expander is adjacent one end of the tube at the tube sheet surface. When an axial compressive force is applied to the expanders by the draw bar, the tube expands first in the region of the secondary expander and is thus preliminarily anchored within the tube sheet. Next, greater deformation of the tube is produced by the primary expander, which causes the end of the tube to be flared.

Other features and advantages of the present invention will become apparent from the following detailed description, taken in conjunction with the accompanying drawings, which illustrate, by way of example, the principles of the invention.

DETAILED DESCRIPTION

Figure 1:
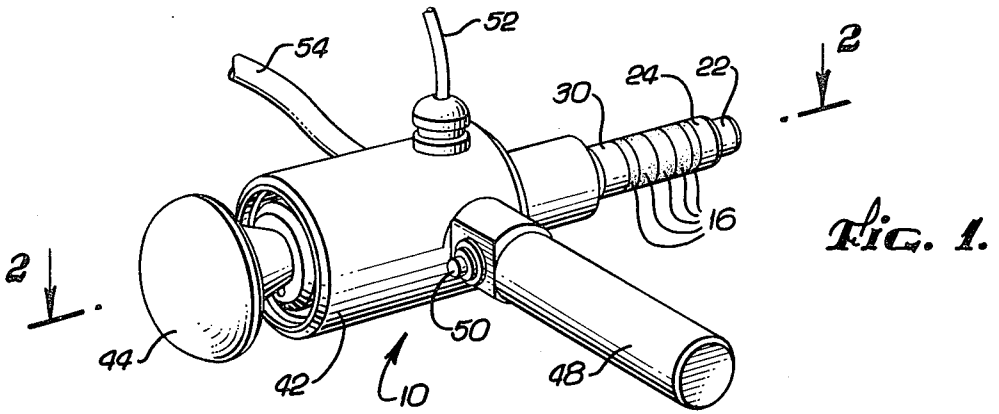
FIG. 1 is a perspective view of the apparatus of the invention.
Figure 2:
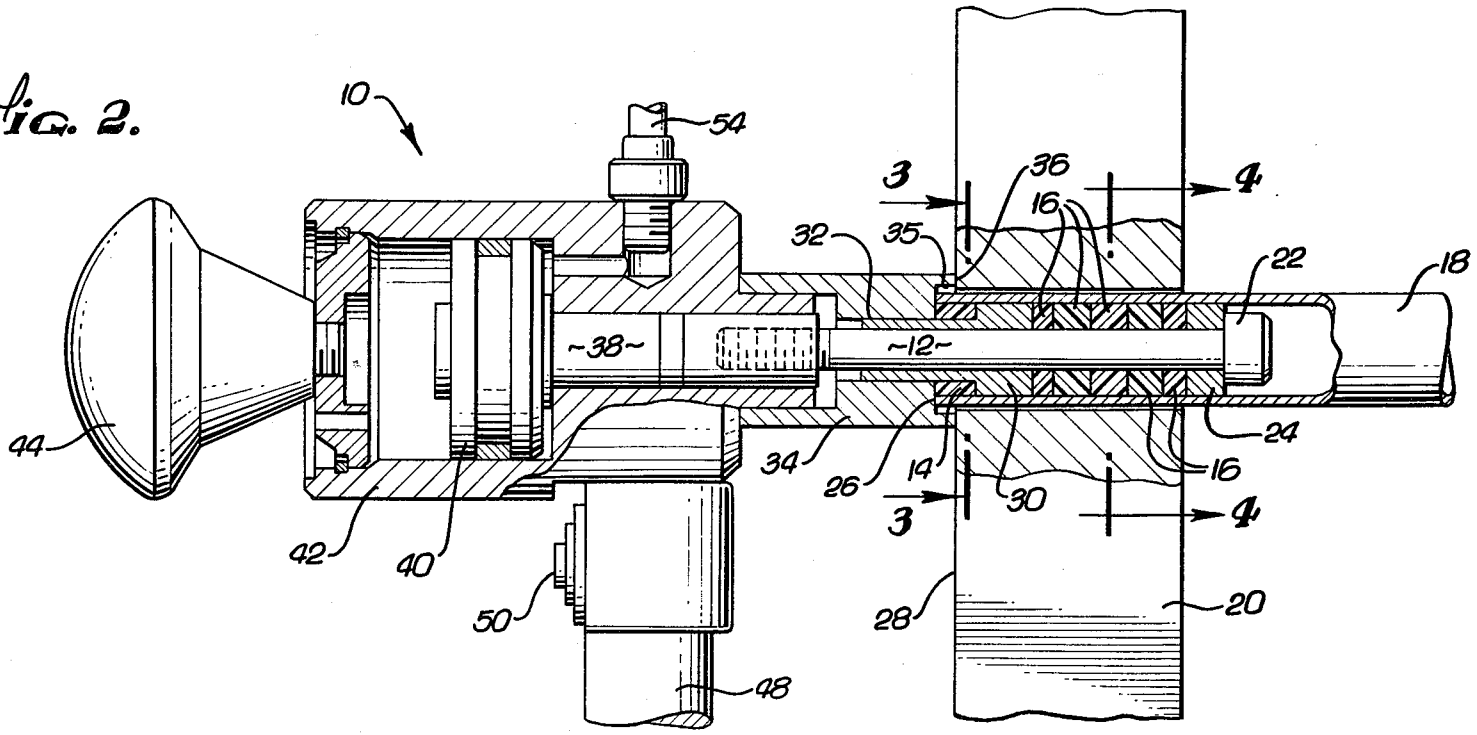
FIG. 2 is a side elevation, mostly in cross-section, showing the apparatus inserted in a tube within a tube sheet, the small annular space between the tube and the sheet being somewhat exaggerated for purposes of illustration.

An apparatus 10, constructed in accordance with the present invention and shown in FIGS. 1 through 5 of the accompanying drawings, includes a draw bar 12 encircled by a single primary expander 14 and a segmented secondary expander 16. The draw bar 12 and the expanders 14 and 16 are adapted to be inserted axially in a tube 18, which may be positioned within a bore of a tube sheet 20, in accordance with FIGS. 2–5.

As best shown in FIGS. 2–5, the draw bar 12 is an elongated member of lesser diameter than the interior of the tube 18. It carries a head 22 at the end inserted in tube 18 first, the secondary expander 16 being spaced from the head by an incompressible metal annular spacer 24. Near the opposite end of the draw bar 12, the primary expander 14 is positioned adjacent to one end 26 of the tube 18 where the tube projects slightly beyond the primary or working face 28 of the tube sheet 20. The primary expander 14 is separated from the secondary expander 16 by an annular spacer 30.

While the primary and secondary expanders 14 and 16 are of the same outer diameter, slightly less than the inside diameter of the tube 18, the primary expander 14 has a greater inside diameter. Thus, while the secondary expander 16 is slidable directly on the draw bar 12, the primary expander 14 is slidable on a sleeve 32 that surrounds the draw bar and acts as a radial spacer. The sleeve 32 is integrally formed with the spacer 30 from which it extends axially.

On the primary side 28 of the tube sheet 20, the draw bar 12 is received by an opening in the center of an anvil 34. An annular notch 35 in this anvil 34 permits it to receive the protruding end 26 of the tube 18 while the face 36 of the anvil 34 serves as an abutment that rests against the primary surface 28 of the tube sheet 20 to position the entire apparatus 10. Of course, the anvil 34 could be differently constructed to cooperate with a tube 18 that ends flush with the working face 28 of the tube sheet 20 or it could be configured to be inserted in the bore of the tube sheet to engage a recessed tube.

The end of the draw bar 12 opposite the head 22 is anchored to an extension 38 of a piston 40, the piston being reciprocable within a hydraulic cylinder 42 (see FIG. 2) that is integrally formed with the anvil 34. At the end of the hydraulic cylinder farthest from the tube sheet 20 is a knob-shaped handle 44 by which the apparatus 10 can be manipulated and held against the tube sheet 20. A cylindrical rod-shaped handle 48 extends from the side of the anvil perpendicular to the draw bar 12 (see FIG. 1). Mounted on the rod-shaped handle 48 is an electrical switch 50 that controls the flow of hydraulic fluid, the switch being connected to a pressurized fluid source (not shown) that it controls by an electrical wire 52 that extends from the anvil 34.

Figure 4:
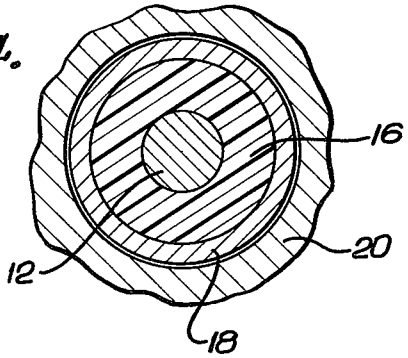
FIGS. 3 and 4 are transverse cross-sections of the apparatus taken as indicated by the lines 3–4 and 4—4 of FIG. 2.
Figure 3:
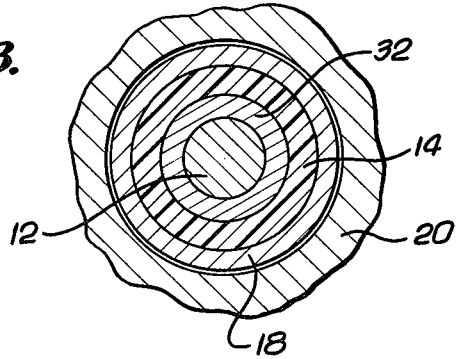

When it is intended to operate the apparatus 10, the draw bar 12 and expanders 14 and 16 are positioned within the tube 18, as explained above, and the draw bar is then actuated by admitting hydraulic fluid to the cylinder 42 through a passage 54 (FIG. 2), thus forcing the piston 40 to move away from the tube sheet 20. As the piston 40 moves, it pulls the draw bar 12 with it, and the head 22 of the draw bar, moving toward the anvil 34, exerts an equal compressive force on the primary expander 14 and the secondary expander 16. It should be noted, however, that the primary expander 14, presents a smaller area opposed to the force of the draw bar 12. In other words, the cross section of the primary expander 14 when viewed with reference to a plane passing transversely through the draw bar 12 (FIG. 3), is not as great as the cross-section of the secondary expander 16 (FIG. 4).

The expanders 14 and 16 are made of polyurethane, a material which has the properties of a solid under normal conditions but behaves as a hydraulic fluid under high pressure. Nevertheless, the polyurethane expanders 14 and 16 have a memory and will return to their original shape after the force of the draw bolt 12 is removed.

The force of the draw bar 12, being applied to a smaller cross-sectional area in the case of the primary expander 14, results in a higher pressure, and thus a higher outwardly directed radial pressure against the walls of the tube 18. Accordingly, the highest outwardly directed radial pressure is produced within that region of the tube 18 corresponding to the axial length of the primary expander 14. A lower pressure is produced within the region of the tube 18 corresponding to the axial length of the secondary expander 16.

Although the pressure produced by the secondary expander 16 is lower, that pressure is applied over a larger surface of the tube 18, due to the length of the secondary expander being many times that of the primary expander 14 in this embodiment of the invention. A greater total radial force is therefor produced by the secondary expander 16.

Three functions are performed by the secondary expander 16. Firstly, it grips the inside of the tube 18 and pulls the tube toward the anvil 34 as the bolt 12 is moved by the piston 40, thereby precisely locating the tube within the tube sheet 20. Secondly, it holds the tube 18 firmly against the anvil 34, thus preventing the primary expander 14 from escaping under pressure from the notch 35. Thirdly, the secondary expander 16 causes the corresponding region of the tube 18 to bulge (see FIG. 5), thus helping to anchor the tube 18 within the tube sheet 20.

Figure 5:
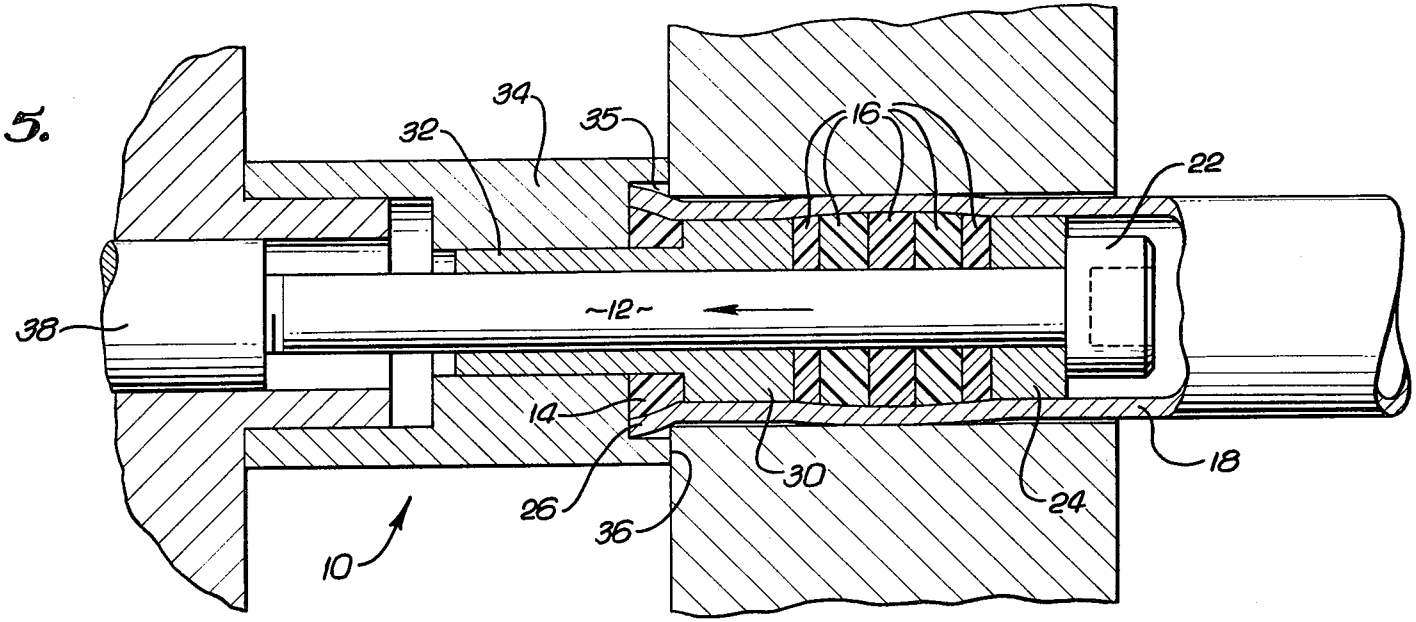
FIG. 5 is a fragmentary view of the inserted apparatus after actuation thereof to expand the tube.

In the next phase of the operation of the apparatus 10, the end 26 of the tube 18 protruding beyond the primary surface 28 of the tube sheet 20 is flared outwardly, as permitted by the size of the notch 35 in the anvil 34 in which it is received. This flaring of the tube 18, as shown in FIG. 5, firmly secures the tube against movement into the tube sheet 20 and away from the primary surface 28.

Hydraulic fluid is then permitted to flow out of the passage 54 by the operation of a valve (not shown) so that the piston 40 can move back toward the tube sheet 20. With the axial force on the expanders 14 and 16 removed, they return to their original shape and the apparatus 10 can be readily withdrawn from the tube 18. The tube 18 is then firmly anchored in the tube sheet 20 and is ready for hydraulic swaging at pressures substantially higher than those which can be obtained in the manner described above. The apparatus 10 is then ready to be used again.

As will be understood from the description above, the present invention provides an apparatus and method by which tubes can be expanded radially and selected hydraulic pressures can be applied within the various axial regions of the tube. The method and apparatus are particularly suitable for anchoring tubes within tube sheets in preparation for subsequent high pressure swaging.

While a particular form of the invention has been illustrated and described, it will be apparent that various modifications can be made without departing from the spirit and scope of the invention.

I claim:

1. An apparatus for generating selected radially expansive pressures with axially separate regions of a tube, said apparatus comprising:

at least one primary expander adapted to be inserted in said tube;

at least one secondary expander adapted to be inserted in said tube and axially positioned therein with respect to said primary expander, said secondary expander having a larger cross section than said primary expander when considered with reference to a plane passing transversely through said tube; and means for compressing said expanders axially with respect to said tube, thereby producing outwardly directed radial pressure against the interior of said tube and causing said primary expander to produce greater pressure due to its smaller cross-sectional area.

2. The apparatus of claim 1 wherein:

said expanders are ring-shaped; and said means for compressing said expanders includes a draw bar extending through said rings.

3. The apparatus of claim 2 wherein said means for compressing said means for compressing said expanders further includes a hydraulic cylinder and piston connected to said draw bar.

4. The apparatus of claim 1 wherein:

said expanders are ring-shaped; and said means for compressing said expanders comprises an anvil member adapted to position said apparatus relative to said tube, a hydraulic cylinder connected to said anvil member and fixed in position with respect thereto, a piston movable within said cylinder, and a draw bar connected to said piston for movement therewith extending axially through said expanders.

5. The apparatus of claim 2 further comprising a sleeve encircled by said primary expander, said draw bar extending through said sleeve and slidable thereon.

6. The apparatus of claim 1 wherein said expanders are formed of polyurethane and behave as liquid at high pressure.

7. An apparatus for generating radially expansive pressures within axially separated regions of a tube, said apparatus comprising:

a draw bar adapted to be inserted in said tube;

at least one primary expander encircling said draw bar;

at least one secondary expander encircling said draw bar, said secondary expander having a larger cross section than said primary expander when considered with reference to a plane passing transversely there through; and means for actuating said draw bar to thereby compress said expanders axially and expand said expanders radially.

8. The apparatus of claim 7 wherein said means for actuating said draw bar includes a hydraulic cylinder and piston.

9. The apparatus of claim 7 further comprising a sleeve encircled by said primary expander, said draw bar extending through said sleeve and slidable therein.

10. The apparatus of claim 7 wherein said expanders are formed of polyurethane and behave as liquid at high pressure.

11. An apparatus for anchoring a tube within a tube sheet in preparation for a subsequent swaging operation, said apparatus comprising:

an anvil adapted to engage a surface of said tube sheet and thereby position said apparatus;

a hydraulic cylinder connected to said anvil and immovable with respect thereto;

a piston movable within said cylinder;

a draw bar connected to said piston for movement therewith and adapted to be inserted in said tube;

a sleeve in which said draw bar is slidable;

a primary expander encircling said sleeve and adapted to be positioned within said tube adjacent to said tube sheet surface;

a segmented secondary expander encircling said draw bar, said secondary expander having a larger cross section than said primary expander when considered with respect to a plane passing transversely through said tube; and a head carried by said draw bar to compress said expanders radially and thereby expand said expanders radially upon axial movement of said draw bar.

12. The apparatus of claim 11 wherein said expanders are made of polyurethane.

13. The apparatus of claim 11 further comprising a spacer disposed between said primary expander and said secondary expander.

14. The apparatus of claim 1, 7 or 11 wherein said secondary expander and said primary expander have cylindrical external configurations and are of substantially the same external diameter.

* * * * *